US005337839A

United States Patent [19]

Warren et al.

[11] Patent Number: 5,337,839

[45] Date of Patent: Aug. 16, 1994

[54] EXTENDING THE LATERAL PORTION OF A SHORT-RADIUS WELLBORE

[75] Inventors: Tommy M. Warren, Coweta; Warren J. Winters, Tulsa, both of Okla.

[73] Assignee: Amoco Corporation, Chicago, Ill.

[21] Appl. No.: 926,983

[22] Filed: Aug. 7, 1992

[51] Int. Cl.[5] ..... E21B 7/08

[52] U.S. Cl. ..... 175/62; 175/73

[58] Field of Search ..... 175/61, 62, 73, 74

[56] References Cited

U.S. PATENT DOCUMENTS 4,601,353 7/1986 Schuh et al. ..... 175/62 X 4,762,186 8/1988 Dech et al. ..... 175/61

5,165,491 11/1992 Wilson ..... 175/73 X

*Primary Examiner*—Terry Lee Melius

*Attorney, Agent, or Firm*—James A. Gabala; Richard A. Kretchmer

[57] ABSTRACT

Conventional drill pipe is rotated at a rate sufficient for distributing deforming forces substantially uniformly around the circumference of the drill pipe at each location along the length of the drill pipe disposed within the curved portion while the pipe is passed through the curved portion of a short-radius wellbore. The drill pipe arrives in the lateral portion in operable condition for drilling to extend the lateral portion and is retrieved from the wellbore in reusable condition.

10 Claims, 2 Drawing Sheets

EXTENDING THE LATERAL PORTION OF A SHORT-RADIUS WELLBORE

The present invention is directed to extending the lateral portion of a short-radius wellbore in a subterranean formation and, more particularly, to extending the lateral portion with conventional drill pipe.

A short-radius wellbore in a subterranean formation aids in increasing recovery of subterranean fluids such as oil and gas from the formation. A short-radius wellbore has a curved portion with a radius of curvature of about 45 feet or less for deviating from vertical and a lateral portion for extending into a fluid-bearing zone of the subterranean formation.

Flexible drill pipe, which is capable of bending through the curved portion without yielding, is used for drilling the curved portion and part of the lateral portion. Commercially available flexible steel drill pipe currently being used for drilling short radius curved wellbores costs at least about 4 times as much as conventional drill pipe, weighs about twice as much as conventional drill pipe, and tends to wear out more quickly.

Conventional drill pipe, designed for drilling a substantially straight wellbore, can be used for extending the lateral portion of a short-radius wellbore having a radius of curvature of greater than about 30 feet. Current technology enables the drilling of a short-radius wellbore having a radius of curvature of about 30 feet or less, for example from about 15 to about 30 feet. In a wellbore having a radius of about 30 feet or less, conventional drill pipe yields while sliding through the curved portion of the wellbore and is not useful for extending the lateral because it is bent. The forces which cause the pipe to yield are hereinafter referred to as the deforming forces. The yielded drill pipe is not reusable when retrieved from the wellbore and must be straightened before it can be reused. Straightening is a time-consuming and costly procedure.

Due to the expense of using flexible drill pipe, it is desirable to pass conventional drill pipe through the curved portion of a short radius wellbore in operable condition for drilling to extend the lateral portion of a short-radius wellbore. It is desirable to retrieve conventional drill pipe from a short-radius wellbore in reusable condition so the pipe does not have to be straightened before it is reused.

An object of this invention is to provide a method of passing conventional drill pipe through the curved portion of a short-radius wellbore and into the lateral portion of the wellbore in operable condition. Another object of this invention is to provide a method of retrieving conventional drill pipe in reusable condition after the drill pipe is passed through the curved portion of a short-radius wellbore. Other objects shall appear hereinafter.

The objects of this invention can be attained by a method comprising rotating a conventional drill pipe in a single direction while passing the drill pipe through a curved portion of a short-radius wellbore in a subterranean formation at a rotation rate sufficient for distributing deforming forces substantially uniformly around the circumference of the drill pipe at each location along the length of the drill pipe disposed within the curved portion.

This invention has the advantage that the lateral portion of a short-radius wellbore, having a curved portion with a radius of curvature about 30 feet or less, can be drilled at a substantially lower cost than would be incurred by use of flexible drill pipe to drill the lateral portion.

Figure 1:
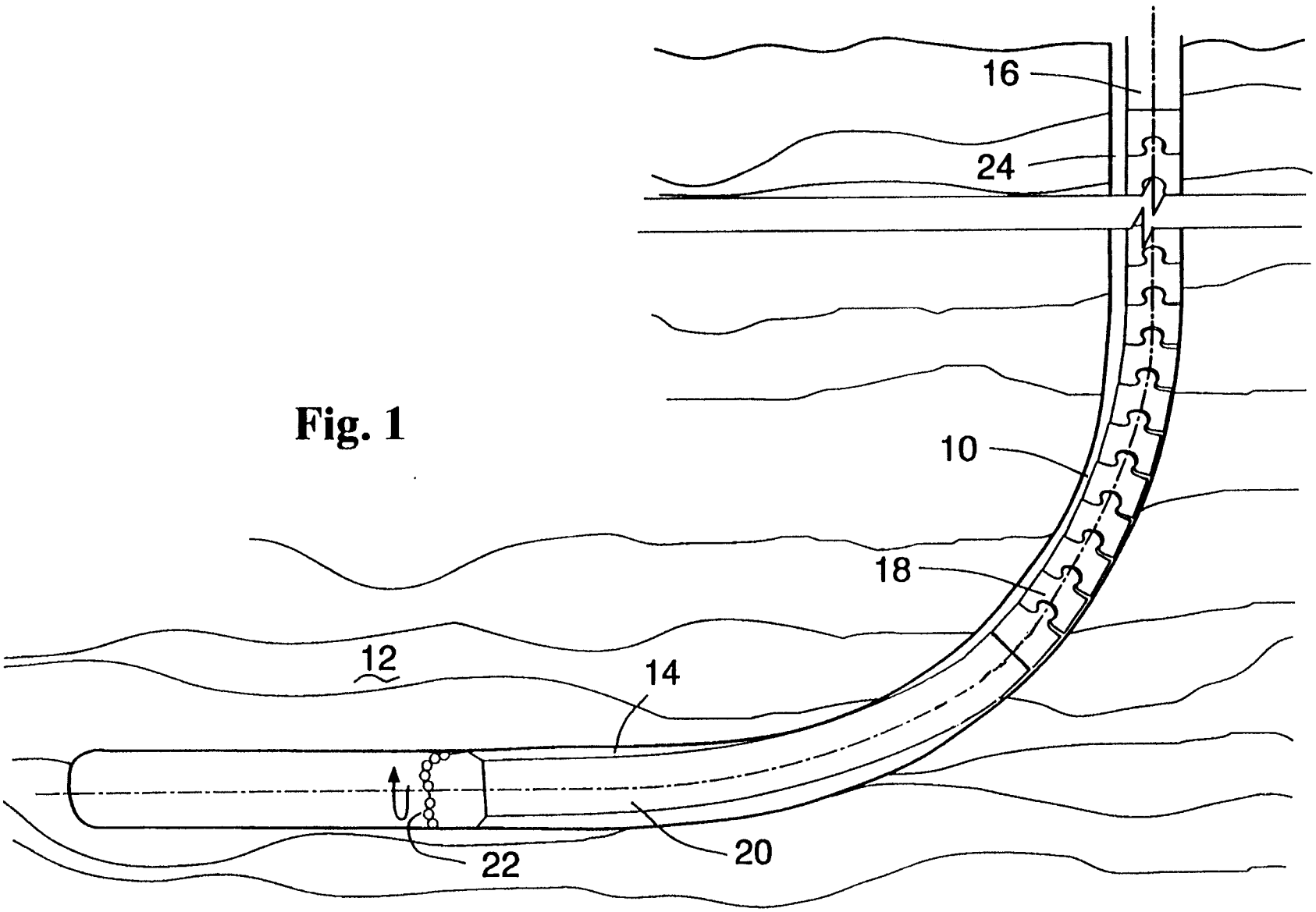
FIG. 1 is a cut-away drawing illustrating use of the method of the present invention in a short-radius wellbore.

For purposes of illustration, the method of this invention is described in reference to a short-radius wellbore having a curved portion with an overall radius of curvature of about 30 feet. Referring to FIG. 1, the curved portion 10 of the short-radius wellbore is about 45 feet long and extends into subterranean fluid-bearing zone 12. The curved portion 10 has an overall radius of curvature of about 30 ft, i.e., the radius of the circle of curvature of a curve having endpoints at the kick-off point of the curved portion 10 and the beginning of the lateral portion 14 of the short-radius wellbore is about 30 feet. The instantaneous radius of curvature of any point on the curve ranges from about 25 to about 30 feet. When the curved portion 10 is drilled with flexible drill pipe, about 90 feet of the lateral portion 14 of the short-radius wellbore is also drilled with the flexible drill pipe. It is desired to extend the lateral portion 14 of the short-radius wellbore about 90 feet further into producing zone 12.

Figure 2:
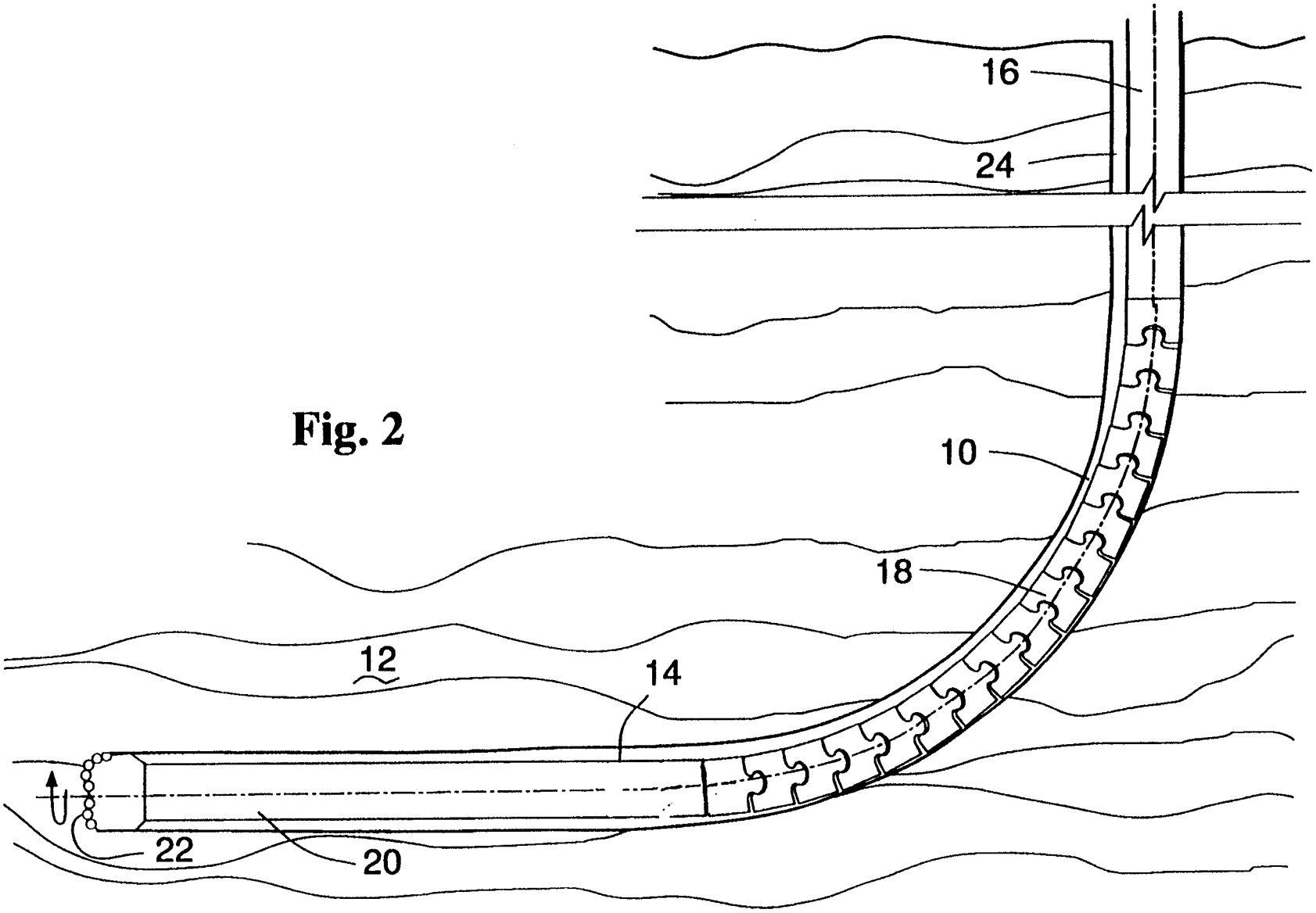
FIG. 2 is a cut-away drawing illustrating a conventional drill pipe disposed within the lateral portion of a short-radius wellbore in operable condition after the drill pipe is passed through the curved portion via the method of the present invention.

The flexible drill pipe used for drilling the curved portion 10 and about 90 feet of the lateral portion 14 of the short-radius wellbore is pulled out of the wellbore. A drillstring is assembled comprising sufficient conventional drill pipe 16 for extending downwardly from the surface to within about 90 feet of the top of curved portion 10, about 135 feet of flexible drill pipe 18, about 90 feet of conventional drill pipe 20, and a drill bit 22. The drillstring is lowered into the wellbore from the surface until the drill bit 22, attached to the lower end of conventional drill pipe 20, is at the top of curved portion 10. Then, the drillstring is simultaneously lowered into the wellbore and rotated in a single direction. The simultaneous lowering into the wellbore and rotating in a single direction is continued until the entire length of conventional drill pipe 20 is positioned in operable condition within the lateral portion 14 of the short-radius wellbore, as illustrated in FIG. 2, for proceeding with extending the lateral portion 14. About 45 feet of flexible drill pipe 18 is positioned in curved portion 10. The rest of the flexible drill pipe 18, about 90 feet, is positioned within the vertical portion 24 of the wellbore just above curved portion 10. Drilling proceeds in a commercial manner, by rotating the drill string from the surface, for extending the lateral portion 14. After drilling, the drillstring is pulled out of the wellbore. As the conventional drill pipe 20 passes through the curved portion 10 while being pulled out of the wellbore, the drill pipe 20 is rotated in a single direction, and is retrieved from the wellbore in reusable condition.

The method of this invention is advantageous in a wellbore having at least one curved portion or a plurality of curved portions. To our knowledge, the method of this invention is advantageous for passing conventional drill pipe through the curved portion of a short-radius wellbore into the lateral portion in operable condition and for retrieving conventional drill pipe in reusable condition after passing the pipe through the curved portion, wherein the curved portion has a radius of curvature such that the drill pipe would not be operable within the lateral portion or reusable once retrieved if the method of this invention were not used. In determining whether application of the method of this invention is necessary for passing a particular conventional drill pipe through a curved portion of a particular short-radius wellbore in operable and reusable condition, the forces on the drill pipe resulting from less flexible connecting joints should be considered in addition to deforming forces resulting from the bending of the pipe. The minimum instantaneous radius of curvature in the curved portion is controlling.

The method of this invention requires rotation of conventional drill pipe at a rate sufficient for distributing the deforming forces substantially uniformly around the circumference of the drill pipe at each location along the length of the drill pipe disposed within the curved portion. The rate of rotation in combination with the lowering or pulling rate desirably minimizes fatiguing the drill pipe.

The following example illustrates the utility of the method of this invention.

The method of this invention is applied for extending the lateral portion of a short-radius wellbore in a hydrocarbon-bearing subterranean formation. The lateral portion is an extension of a curved portion, the curved portion having a radius of curvature of about 24 feet and a length of about 36 feet. For increasing production of hydrocarbons from the formation, it is desirable to extend the lateral portion from a length of about 245 feet to about 277 feet. A drill pipe having an outer diameter of 2⅜ in. is required for extending the lateral portion. Commercially available API S135 drill pipe is rotated at a rate of from about 10–15 rpm as it is passed through the curved portion at a rate of about 2.25 feet per minute into the lateral portion in operable condition. After the lateral portion is extended, the drill pipe is again rotated at a rate of from about 10–15 rpm as it is is passed through the curved portion at a rate of about 2.25 feet per minute and is retrieved from the wellbore in reusable condition. At this rate of rotation, the S135 drill pipe is rotated about 200 times while in the curved portion. The S135 drill pipe has a fatigue life of about 10,000 cycles for the bending stress resulting from bending in the 24 ft radius curved portion. Thus, only about 2% of the fatigue life of the S135 drill pipe is consumed during the rotation in the curved portion, as is desirable for applying the method of this invention in a manner which minimizes fatiguing the conventional drill pipe.

Although the present invention is described in relation to particular embodiments, further modifications, apart from those shown or suggested herein, can be made within the scope and spirit of the present invention.

What is claimed is:

1. In a short-radius curved wellbore having at least one curved portion connected to at least one lateral portion, a method of extending the lateral portion of the wellbore, comprising the steps of:

(a) passing a conventional API drill pipe through a curved portion of a short-radius wellbore in a subterranean formation at a generally uniform insertion rate of V ft/minute, said curved portion having a predetermined radius of curvature of R ft, said drill pipe having a predetermined fatigue life of L cycles; and (b) simultaneously rotating said conventional drill pipe in a single direction at a rate of W revolutions/minute to distribute deforming forces substantially uniformly around the circumference of said drill pipe at each location along the lenght of the drill pipe disposed within said curved portion, wherein the product of R and W is less than about two percent the product of L and V.

2. The drilling method of claim 1, wherein the curved portion has a radius of curvature of from about 15 feet to about 30 feet.

3. The drilling method of claim 2, wherein the conventional drill pipe is rotated at a rate of from about 10 rpm to about 15 rpm.

4. The drilling method of claim 1, wherein said radius of curvature is no more than 45 feet.

5. The method of claim 1, wherein step (b) W is at least 10 rpm and in step (a) V is at least 2 feet/minute.

6. The method of claim 5, wherein said conventional API drill pipe is API S135 drill pipe.

7. In a short-radius curved wellbore having at least one curved portion connected to at least one lateral portion, a method of extending the lateral portion of the wellbore, comprising the steps of:

(a) passing a conventional API S135 drill pipe through a curved portion of a short-radius wellbore in a subterranean formation at a rate of at least about 2 feet per minute to minimize fatiguing said drill pipe, said curved portion having a radius of curvature in the range of about 15 feet to about 30 feet, said drill pipe having a diameter of about 2⅜ inches; and (b) simultaneously rotating said conventional drill pipe in a single direction at a rotation rate of from about 10 rpm to about 15 rpm to distribute drill pipe at each location along the length of said drill pipe that is disposed within the curved portion of the wellbore.

8. The method of claim 7, further including the step of:

(c) drilling said wellbore to extend said at least one lateral portion by rotating the drill pipe from the surface.

9. The drilling method of claim 8, further comprising the steps of:

(d) rotating said conventional drill pipe in said single direction while;

(e) retrieving said drill pipe through the curved portion of the short-radius wellbore at a rate of withdrawal and rotation that said drill pipe is removed from the wellbore in reusable condition.

10. A drilling method comprising the steps of:

(a) passing a conventional drill pipe through the curved portion of a short-radius wellbore in a subterranean formation at a rate of about 2.25 feet per minute, said curved portion having a radius of curvature of from about 15 feet to about 30 feet; and (b) simultaneously rotating said conventional pipe in a single direction at a rotation rate from about 10 rpm to about 15 rpm.

* * * * *

UNITED STATES PATENT AND TRADEMARK OFFICE
CERTIFICATE OF CORRECTION

PATENT NO.: 5,337,839

DATED: August 16, 1994

INVENTOR(S): Tommy M. Warren, Warren J. Winters

It is certified that error appears in the above-identified patent and that said Letters Patent is hereby corrected as shown below:

| Col. | Line | |
|---|---|---|
| 4 | 38 | "to distribute drill pipe at each location" should read --to distribute deforming forces substantially uniformly around the circumference of the drill pipe at each location" |

Signed and Sealed this

Eighth Day of November, 1994

Bruce Lehman

*Attest:*

BRUCE LEHMAN

*Attesting Officer*

*Commissioner of Patents and Trademarks*